US006884209B2

(12) United States Patent
Roozrokh

(10) Patent No.: US 6,884,209 B2
(45) Date of Patent: Apr. 26, 2005

(54) APPARATUS AND METHOD FOR FOLDING AND STACKING NAPKINS

(75) Inventor: Shahram Roozrokh, Hauppauge, NY (US)

(73) Assignee: American Trade Names & Patents LLC, Hauppage, NY (US)

( * ) Notice: Subject to any disclaimer, the term of this patent is extended or adjusted under 35 U.S.C. 154(b) by 38 days.

(21) Appl. No.: 10/330,720

(22) Filed: Dec. 30, 2002

(65) Prior Publication Data

US 2004/0048727 A1 Mar. 11, 2004

Related U.S. Application Data

(60) Provisional application No. 60/409,691, filed on Sep. 10, 2002.

(51) Int. Cl.[7] ..... B31F 1/10

(52) U.S. Cl. ..... 493/435; 493/410; 493/424; 493/428

(58) Field of Search ..... 493/405, 410, 493/416, 424, 427, 428, 434, 435, 442, 454, 353

(56) References Cited

U.S. PATENT DOCUMENTS

| | | | | | |
|---|---|---|---|---|---|
| 1,974,149 | A | | 9/1934 | Christman | 270/69 |
| 2,054,426 | A | | 9/1936 | Kahn | 270/83 |
| 2,057,879 | A | | 10/1936 | Campbell | 270/21 |
| 3,689,061 | A | | 9/1972 | Nystrand | 270/66 |
| 3,947,013 | A | * | 3/1976 | Nystrand | 493/422 |
| 4,349,185 | A | | 9/1982 | Small et al. | 270/32 |
| 4,360,194 | A | | 11/1982 | Bradley | 270/51 |
| 4,625,957 | A | | 12/1986 | DuFresne | 271/214 |
| 4,770,402 | A | * | 9/1988 | Couturier | 270/39.02 |
| 4,824,426 | A | * | 4/1989 | DuFresne | 493/346 |
| 4,865,579 | A | | 9/1989 | Kirby et al. | 493/458 |
| 4,969,862 | A | * | 11/1990 | Ehlscheid | 493/359 |
| 5,088,707 | A | * | 2/1992 | Stemmler | 270/39.02 |
| 5,356,131 | A | | 10/1994 | Mauro | 271/288 |
| 5,730,695 | A | * | 3/1998 | Hauschild et al. | 493/416 |
| 6,283,905 | B1 | * | 9/2001 | Singh | 493/360 |
| 6,350,223 | B1 | | 2/2002 | Niedermeyer | 493/359 |
| 6,383,124 | B1 | * | 5/2002 | St. Germain et al. | 493/353 |
| 6,446,961 | B1 | * | 9/2002 | Foret et al. | 271/259 |

* cited by examiner

*Primary Examiner*—Eugene Kim
*Assistant Examiner*—Christopher Harmon
(74) *Attorney, Agent, or Firm*—Cohen, Pontani, Lieberman & Pavane

(57) ABSTRACT

A folding and stacking device for folded sheet articles includes a folding device for outputting a first set of sheet articles having a first fold and a second set of sheet articles having a second fold. Sheet articles from the first and second sets of sheet articles are alternatingly placed on a stack so that the first and second folds are on opposing sides of the stack to evenly distribute the sheet article material on both sides of the stack.

12 Claims, 6 Drawing Sheets

APPARATUS AND METHOD FOR FOLDING AND STACKING NAPKINS

RELATED APPLICATIONS

Priority is claimed on U.S. Provisional Patent Application Ser. No. 60/409,691, filed on Sep. 10, 2002.

BACKGROUND OF THE INVENTION

1. Field of the Invention

The present invention relates to a device for folding and stacking folded sheet articles.

2. Description of the Related Art

A known apparatus for folding and stacking ⅛ fold sheet articles such as napkins is illustrated schematically in FIGS. 1 and 2. A web 10 of material for forming the napkin is fed to a first folding device 12, i.e., a plow, for making a first fold 13, i.e., a plow fold, along a length of the web. After passing over the plow, the folded web is fed between an anvil roll 14 and a knife roll 16 where it is cut to a length of a napkin. The cut napkin length is then folded along a quarter fold line on a quarter fold roll 18 while the napkin length is held onto the anvil roll 14 by a vacuum. FIG. 3 shows the cut napkin 11 after being folded by the quarter fold roll along the quarter fold line 17. After the quarter fold, the napkin is fed to a ⅛ fold roll 20 and folded along a ⅛ fold line 19 while the napkin 11 is held between the quarter fold roll 18 and the ⅛ fold roll 20. The completely folded napkin 11 is then fed to a stacking section where a required count of napkins are fed to a stack 22 for further packaging such as banding.

The use of vacuum folding techniques for folding sheet articles is disclosed, for example, in U.S. Pat. Nos. 1,974,149 and 3,689,061, the entire contents of which are incorporated herein by reference.

As shown at the bottom of FIG. 5, the fold 13 is not made in the center of the web 10. Accordingly, the stack of napkins is more dense on the left side of the stack because of the nature of the plow fold 13. Additionally, even if the fold is made at the center of the web, an edge of the napkin with a fold will be thicker than an edge without a fold. If the napkins are stacked so that their folds lie next to one another, one edge of a stack of folded napkins is significantly thicker or more dense than another edge of the stack of folded napkins which has no folds, thereby making it difficult to handle the stack of folded napkins during subsequent operations, such as packaging.

SUMMARY OF THE INVENTION

It is an object of the present invention to provide a method and apparatus for folding and stacking sheet articles which produces a more uniform stack thickness.

The object of the present invention is met by a method and apparatus for folding sheet articles using two different folding devices. A stack of sheet articles is formed by interleaving the sheet articles from the two-different folding devices. The sheet article may be made from any substantially planar and foldable sheet material such as, for example, paper, plastic, or metal. According to an embodiment of the present invention, the apparatus for folding sheet articles includes two folding devices which output sheet articles having folds on opposite sides of the folded article. The folded sheet articles from the two folding devices are interleaved so that the stack includes the two opposing folds. By alternating the folded sheet articles from the two folding devices in the stack, the sheet material is evenly distributed on the opposing sides of the stack associated with the two folds, thereby producing a stack of uniform thickness.

A uniformly thick stack is easier to handle, helps reduce jam-ups in banders and case packers, and facilitates an even distribution of weight when the stacks are placed in boxes for shipping. The present invention also reduces waste because the ease of handling the product reduces downtime of the folding device, thereby increasing the rate of production and reducing the cost of production.

In a more specific embodiment, the present invention is directed to a device for folding ⅛ fold napkins with a first folding device, i.e., a plow, for making a first fold along a longitudinal length of the napkin, a quarter folder for quarter folding the napkin, and a ⅛ folder for ⅛ folding the napkin. According to the invention, two plow folders are used for receiving two separate webs of napkin material. The plow folders fold each web along a longitudinal length of the web. A separate quarter fold roll may be associated with each plow and a shared cross drive ⅛ fold cylinder may be used in the final ⅛ fold step for each napkin. Alternatively, separate ⅛ fold cylinders may be used with each feeding the ⅛ folded napkin to a belt guided accumulator table.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
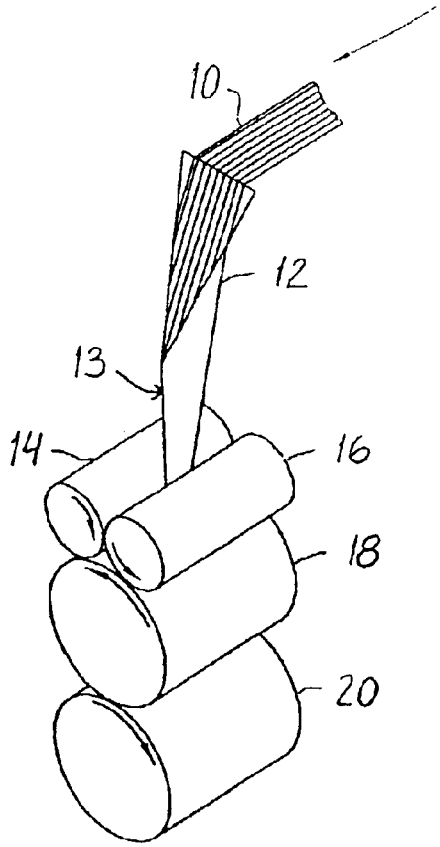
Fig. 1 Prior Art
FIG. 1 is a schematic perspective view of a prior art napkin folder.
Figure 2:
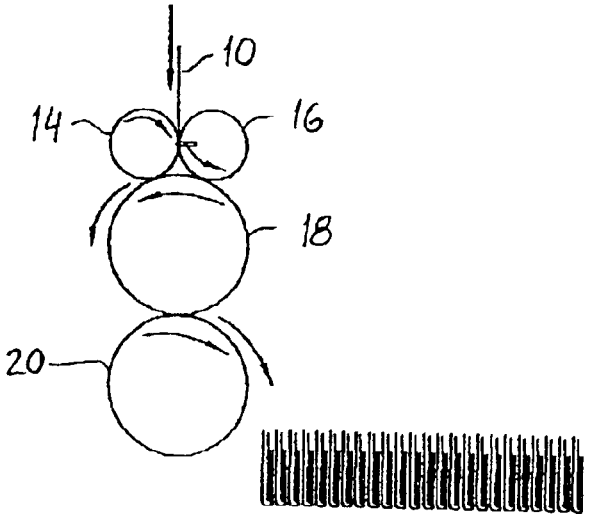
Fig. 2 Prior Art
FIG. 2 is an end view of the cylinders of the folder in FIG. 1.
Figure 3:
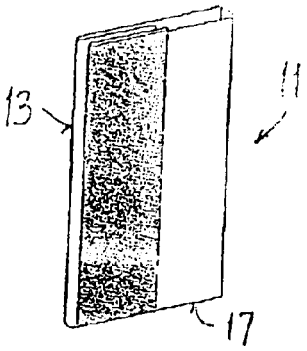
Fig. 3 Prior Art
FIG. 3 is a perspective view of a quarter folded napkin.
Figure 4:
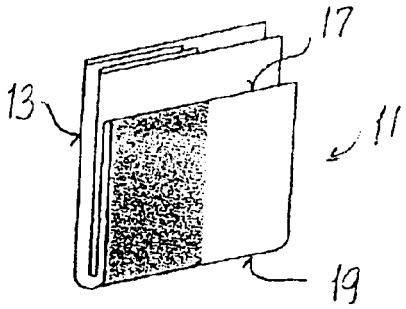
Fig. 4 Prior Art
FIG. 4 is a perspective view of a ⅛ folded napkin.
Figure 5:
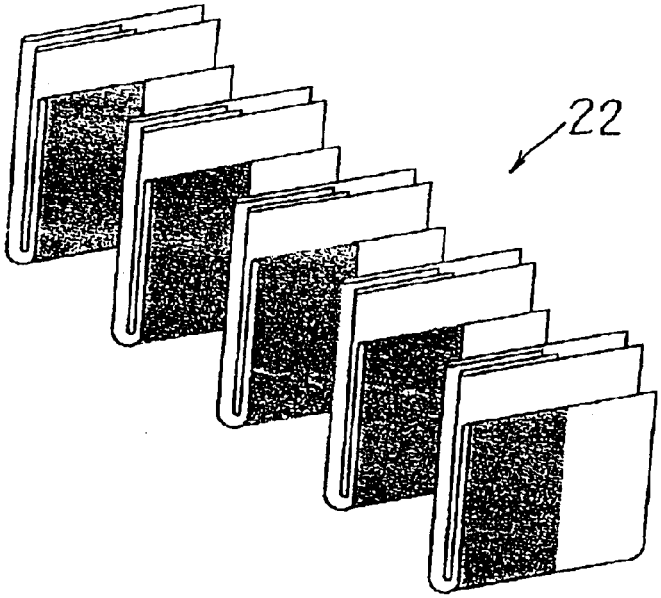
Fig. 5 Prior Art
FIG. 5 is a perspective view of a stack of folded napkins generated by the device of FIG. 1.
Figure 6:
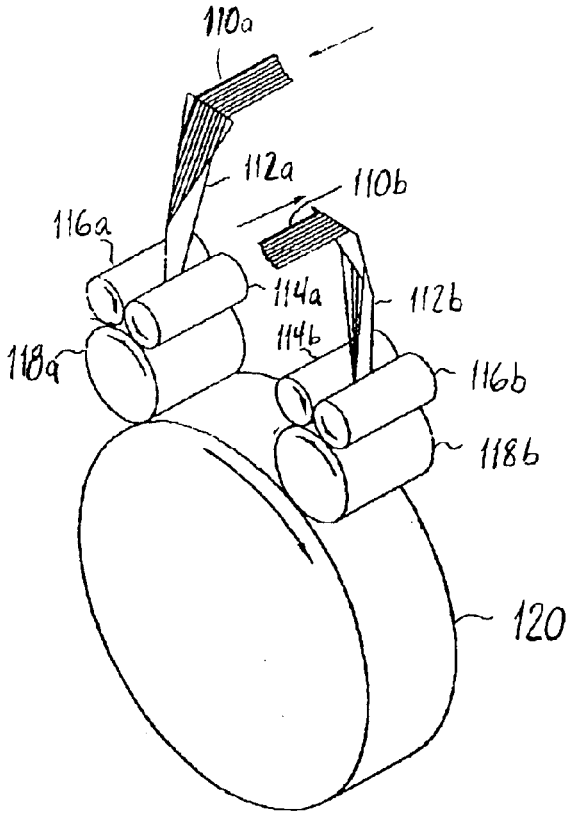
FIG. 6 is a schematic perspective view of a sheet article folder according to an embodiment of the present invention.
Figure 7:
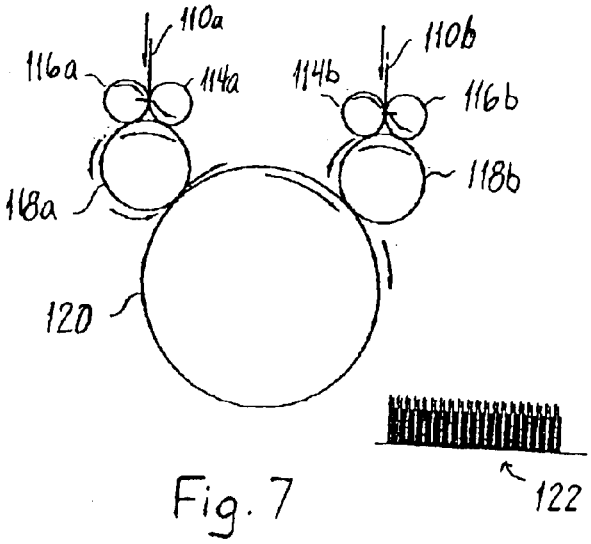
FIG. 7 is an end view of the cylinders of the sheet article folder in FIG. 6.

A sheet article folder and stacker according to the present invention is shown in FIGS. 6 and 7 which includes first and second folding devices 112*a*, 112*b*, i.e., plows, for receiving first and second webs 110*a*, 10*b*. After being folded along a first fold line 113*a* in the first plow 112*a*, the first web 110*a* is fed through a set of anvil and knife rolls 114*a*, 116*a* where it is cut to proper length for the article to be formed such as, for example, a napkin, a greeting card, a pamphlet, a brochure, or any other sheet article which has one or more folds. The sheet article is not limited to paper and may be made of any substantially planar and foldable sheet material such as plastic or metal. The cut sheet article is then fed to a quarter fold roll 118*a* where it is subjected to a quarter fold. The quarter folded sheet article is then fed to a common ⅛ fold roll 120 where it is folded into the final product. Similarly, the second web 110*b* is fed through a set of anvil and knife rolls 114*b*, 116*b* for cutting, a quarter fold roll 118*b* for quarter folding and then to the common ⅛ fold roll 120 for ⅛ folding. The quarter fold rolls 118*a*, 118*b* and ⅛ fold roll 120 may comprise vacuum cylinders which use vacuum folding techniques described, for example, in U.S. Pat. Nos. 1,974,149 and 3,689,061, the entire contents of which are incorporated herein by reference. Alternatively, the quarter fold rolls 118*a*, 118*b* and ⅛ fold rolls 120 may use mechanical tuckers and grippers, such as, for example, those disclosed in U.S. Pat. Nos. 2,054,426 and 2,057,879, the entire contents of which are also incorporated herein by reference.

Figure 8:
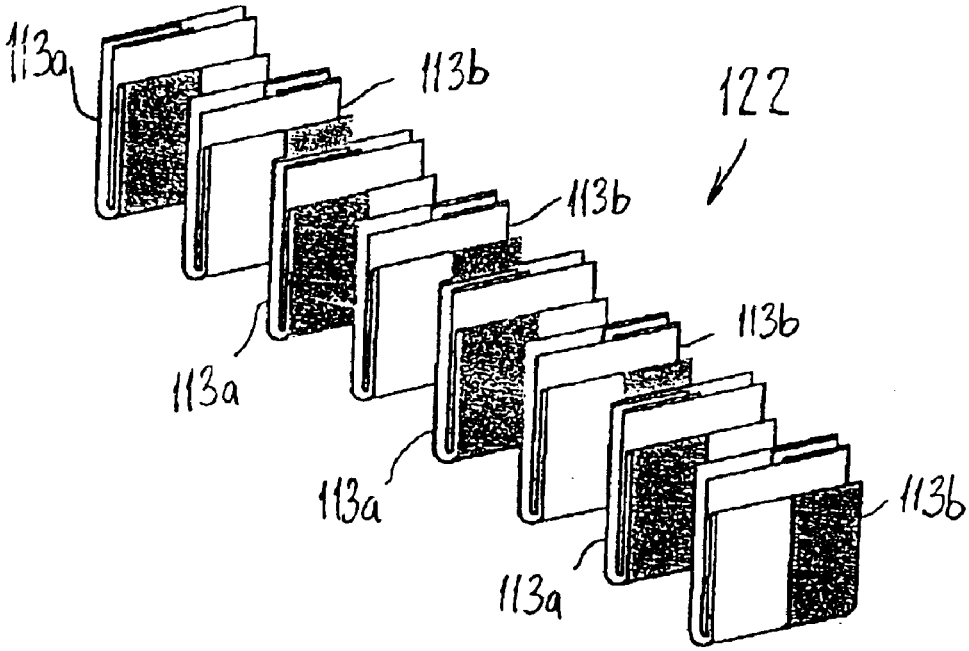
FIG. 8 is a perspective view of a stack of sheet articles folded by the device of FIGS. 6 and 7.

The ⅛ folded sheet articles from the first and second webs are then moved to a stack 122 so that sheet articles from the first and second webs are interleaved. The orientation of the first and second folding devices 112*a*, 112*b* is such that the folds 113*a* created by the first folding device 112*a* on the first web 110*a* are arranged on an opposing side of the stack 122 from the folds 113*b* created by the second folding device 112*b* on the second web 110*b* as shown in FIG. 8. Furthermore, the feeding of the sheet articles from the first and second webs to the stack is synchronized, and/or the quarter fold rolls 118*a*, 118*b* are positioned, so that the ⅛ folded sheets articles are alternately placed on the stack. The alternating folds 113*a*, 113*b* in the stack 122 create an even distribution of sheet material in the stack 122, thereby making the stack more stable than if the folds 113*a* and 113*b* were all arranged on the same side.

As seen from FIG. 8, the folds 113*a*, 113*b* are not made along the center of the web 110*a*, 10*b*. Rather, they are made such that the width of material on one side of the fold is greater than the width on the other side of the fold. However, this offset fold is not a requirement of the present invention. The folds 113*a*, 113*b* may be made along the center of the web. As further seen from FIG. 8, the first napkin (at the top of FIG. 8) has its ⅛ fold on its left edge, the second napkin has its ⅛ fold on its right edge, the third napkin has its ⅛ fold on its left edge, and so forth. As a result of this alternating stacking, the left and right edges of the stack of napkins have substantially the same thickness or density.

Although the preferred embodiment shows that the sheet article is first folded lengthwise, then in a quarter fold, and then in an eighth fold, the present invention requires only that the sheet article be folded once and that this fold be alternately arranged on opposing sides of a stack. According to the present invention, two separate trains of sheet articles are folded in folders and alternately placed on a stack of sheet articles so that the fold in articles from the first train is on an opposing side of the stack from the fold in articles from the second train. That is, the interleaved articles include folds on opposing sides of the stack.

Moreover, the anvil and knife rolls 114*a*, 116*a*, 114*b*, and 116*b* may be omitted if the sheet articles are fed in pre-cut condition to the first folding device 112*a*, 112*b*. If cutting of the web is not required, a vacuum roll may be used in place of the anvil and knife rolls.

Figure 9:
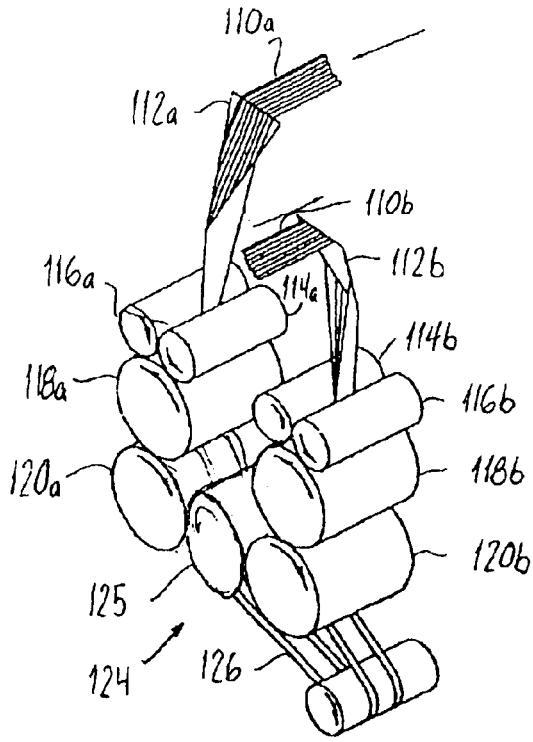
FIG. 9 is a schematic perspective view of a sheet article folder according to another embodiment of the present invention.
Figure 10:
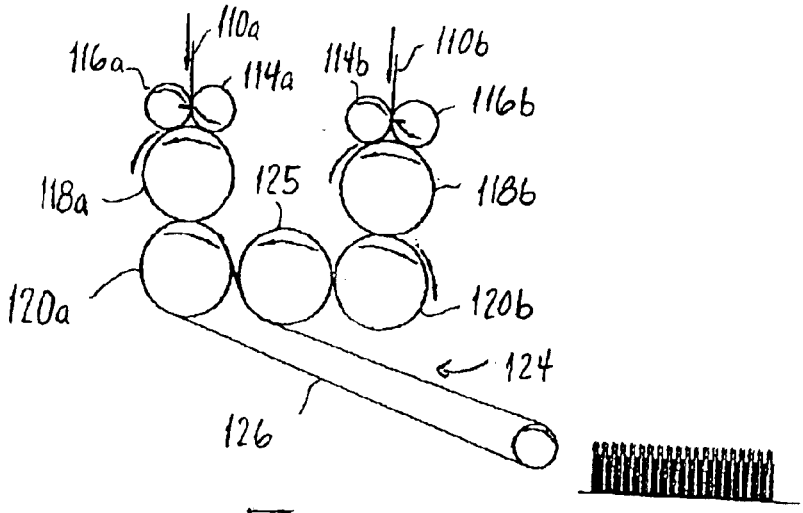
FIG. 10 is an end view of the cylinder arrangement of the folder in FIG. 9.

FIGS. 9 and 10 show another sheet article folder according to the present invention in which the ⅛ fold roll 120 of FIGS. 6 and 7 is replaced by a individual rolls 120*a*, 120*b* and a belt 126. This embodiment also includes first and second folding devices 112*a*, 112*b* for receiving first and second webs 110*a*, 110*b* and first and second quarter fold rolls, respectively. Furthermore, the embodiment of FIGS. 9 and 10 uses separate ⅛ fold rolls 120*a*, 120*b*. The ⅛ folded sheet articles are fed from the ⅛ fold rolls 120*a*, 120*b* to a transport device 124 comprising a transport roll 125 between the ⅛ fold rolls 120*a*, 120*b* and a belt 126 which moves the folded sheet articles to the stack 122. The folded sheet articles are alternatingly placed on the belt 126 which then places the folded articles on the stack 122.

Figure 11:
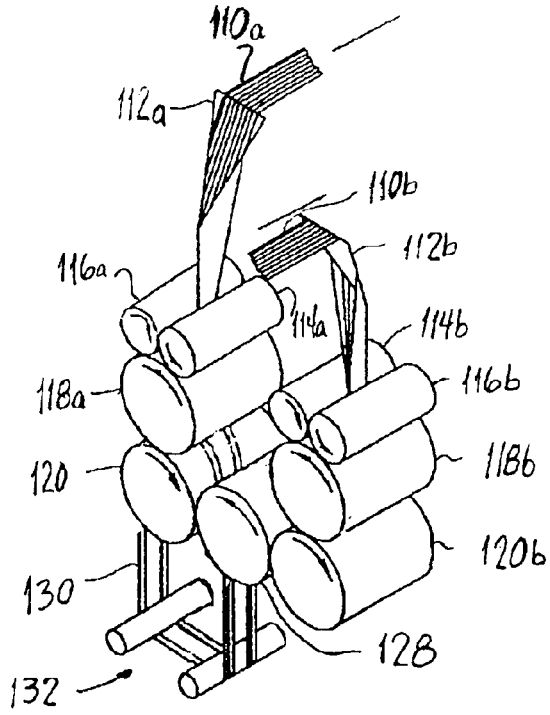
FIG. 11 is a schematic perspective view of a sheet article folder according to yet another embodiment of the present invention.
Figure 12:
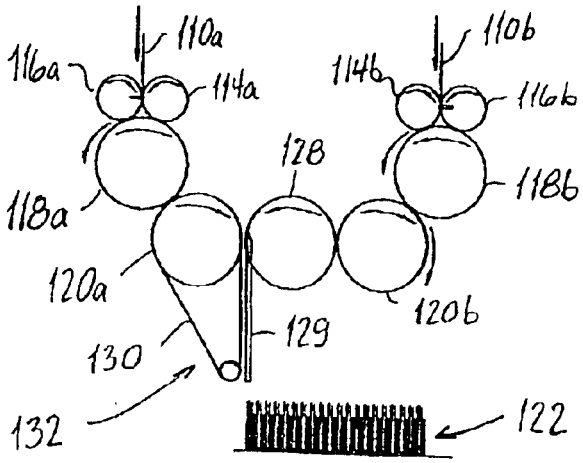
FIG. 12 is an end view of the cylinder arrangement of the folder in FIG. 11.

Instead of transport device 124, many other types of transport devices may be used which move the folded sheet articles to the stack while maintaining the interleaved order of the sheet articles. FIGS. 11 and 12 show another example of a transport device 132 for moving the folded sheet articles to the stack. The transport device 132 includes a belt 130 associated with the ⅛ fold roll 120*a*. A transport roll 128 is used to transport folded sheet articles from ⅛ fold roll 120*b* to the belt 130. Furthermore, a guide 129 is arranged adjacent to the belt 130 to guide the sheet articles onto the stack.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for folding sheet articles and stacking the folded sheet articles in a stack, comprising:

a folding device for outputting a first set of folded sheet articles having a first fold and a second set of sheet articles having a second fold, wherein said first and second folds are longitudinal folds made along a longitudinal line on each of the sheet articles substantially parallel to a feed direction of the sheet articles;

first and second quarter fold devices for respectively folding the sheet articles received from said first and second folders along a first transverse fold line;

an eighth fold device for folding the sheet articles received from said first and second quarter fold devices along a second transverse fold line; and a transport device for transporting the first and second sheet articles from the eighth fold device to the stack and alternatingly feeding the first and second articles to the stack, the first and second folds of said first and second articles being output from the folding device so that the first and second folds are arranged on opposing sides of the stack by said transport device.

2. The apparatus of claim 1, wherein said folding device comprises a first folding device for outputting the first set of folded sheet articles and a second folding device for outputting the second set of folded sheet articles.

3. The apparatus of claim 2, wherein said first folding device is arranged for receiving a first web of sheet article material and said second folding device is arranged for receiving a second web of sheet article material.

4. The apparatus of claim 3, wherein said first and second webs are received from opposing sides of said apparatus.

5. The apparatus of claim 3, further comprising first and second cutters for respectively cutting sheet article lengths from the first and second webs.

6. The apparatus of claim 5, wherein said first and second folders are arranged upstream of said first and second cutters.

7. The apparatus of claim 1, wherein said eighth fold device comprises a common eighth fold device for folding sheet articles received from said first and second quarter fold devices along a transverse fold line.

8. The apparatus of claim 1, wherein said eighth fold device comprises first and second eighth fold devices for respectively folding the sheet articles received from said first and second quarter folders along a second transverse fold line.

9. The apparatus of claim 1, wherein said sheet articles are napkins.

10. The apparatus of claim 1, wherein said sheet articles are made of plastic.

11. The apparatus of claim 1, wherein said sheet articles are made of metal.

12. The apparatus of claim 1, wherein said sheet articles are one of greeting cards, pamphlets, and brochures.

* * * * *